US007481426B2

(12) United States Patent
Otsuka et al.

(10) Patent No.: US 7,481,426 B2
(45) Date of Patent: Jan. 27, 2009

(54) MEDIUM FEEDER AND LIQUID EJECTING APPARATUS OR RECORDING APPARATUS INCORPORATING THE SAME

(75) Inventors: Kazuo Otsuka, Nagano-ken (JP); Atsuhiko Takeuchi, Nagano-ken (JP); Toshio Miyake, Nagano-ken (JP); Yuji Miyamoto, Nagano-ken (JP); Daisuke Watanabe, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 332 days.

(21) Appl. No.: 11/350,574

(22) Filed: Feb. 9, 2006

(65) Prior Publication Data

US 2006/0197275 A1 Sep. 7, 2006

(30) Foreign Application Priority Data

Feb. 9, 2005 (JP) ..... 2005-032889
Jun. 22, 2005 (JP) ..... 2005-181811

(51) Int. Cl.
*B65H 1/00* (2006.01)

(52) U.S. Cl. ..... 271/171; 271/127

(58) Field of Classification Search ..... 271/126, 271/127, 171; 400/692, 630, 633, 633.1
See application file for complete search history.

(56) References Cited

U.S. PATENT DOCUMENTS 4,711,442 A * 12/1987 Runzi ..... 271/22
4,714,243 A * 12/1987 Staniszewski ..... 271/171

(Continued)

FOREIGN PATENT DOCUMENTS

EA 0 230 548 A2 8/1987

(Continued)

OTHER PUBLICATIONS

European Search Report dated Jul. 23, 2007.

*Primary Examiner*—Kaitlin S Joerger
(74) *Attorney, Agent, or Firm*—Edwards Angell Palmer & Dodge LLP; John J. Penny, Jr.

(57) ABSTRACT

A medium feeder is adapted to feed a target medium to a liquid ejecting section in which liquid is ejected toward the target medium. A feeding roller is adapted to come in contact with the target medium, thereby feeding the target medium in a first direction. A first supporter opposes the feeding roller and has a first supporting face adapted to support the target medium. A second supporter is disposed in an upper side of the first supporter and has a second supporting face adapted to support the target medium. A first edge guide is provided on the first supporter so as to be movable in a second direction perpendicular to the first direction, and has a first guiding face adapted to come in contact with a first side edge of the target medium. A second edge guide is provided on the second supporter so as to be movable in the second direction, and has a second guiding face adapted to come in contact with the first side edge of the target medium. The second edge guide is coupled with the first edge guide so that the first edge guide and the second edge guide move together. A retainer is provided in the second edge guide and operable to retain the second edge guide at an arbitrary position within a movable range of the second edge guide.

15 Claims, 8 Drawing Sheets

U.S. PATENT DOCUMENTS

| | | | | |
|---|---|---|---|---|
| 4,729,683 | A * | 3/1988 | Staniszewski | 400/624 |
| 7,029,004 | B2 * | 4/2006 | Asada et al. | 271/121 |
| 2003/0178764 | A1 | 9/2003 | Hasegawa | |

FOREIGN PATENT DOCUMENTS

| | | |
|---|---|---|
| JP | 10-53357 | 2/1998 |
| JP | 11-228000 | 8/1999 |
| JP | 2002-154725 | 5/2002 |
| JP | 2002-255360 | 9/2002 |
| JP | 2002-362787 | 12/2002 |
| JP | 2004-051264 | 2/2004 |

* cited by examiner

MEDIUM FEEDER AND LIQUID EJECTING APPARATUS OR RECORDING APPARATUS INCORPORATING THE SAME

BACKGROUND OF THE INVENTION

The present invention relates to a liquid ejecting apparatus or a recording apparatus provided with a medium feeder operable to support and feed a target medium to be subjected to a liquid ejecting operation or a recording operation.

The liquid ejecting apparatus is not limited to a printer, a copier, or a facsimile which employs an ink jet recording head and ejects ink from the recording head to a recording medium, to thus effect recording. The liquid ejecting apparatus is employed to encompasses an apparatus that ejects a liquid appropriate to an application, in place of ink, from a liquid ejecting head corresponding to the ink jet recording head onto a target medium corresponding to a recording medium, thereby causing the liquid to adhere to the medium.

In addition to the recording head, the liquid ejecting head encompasses a coloring material ejecting head used for manufacturing a color filer such as a liquid-crystal display or the like; an electrode material (conductive paste) ejecting head used for forming electrodes, such as an organic EL display or a field emission display (FED) or the like; a bio-organic substance ejecting head used for manufacturing a bio-chip; a sample ejecting head serving as a precision pipette; and the like.

The recording apparatus is not limited to a printer, a copier, or a facsimile which employs an ink jet recording head and ejects ink from the recording head to a recording medium, to thus effect recording. The recording apparatus is employed to encompasses an apparatus that performs recording on a recording medium in a dot-impact manner or a thermal transfer manner.

An ink jet printer is an example of the recording apparatus or the liquid ejecting apparatus. In many cases, an ink jet printer is provided with a feeder (a so-called automatic sheet feeder) which can set a plurality of printing sheets serving as a recording medium or a target medium. Such a feeder has an edge guide for guiding an edge of a sheet as disclosed in Japanese Patent Publication No. 2002-255360A. The edge guide is provided so as to be slidable in the widthwise direction of the sheet, as well as to be retained at an appropriate position corresponding to the size of the sheet. By such an edge guide, edges of sheets are aligned, and during feeding each of the sheets is fed in a correct attitude without being skewed.

In recent years, ink jet printers of a type integrated with a scanner have been on the market. The scanner-integrated ink jet printer has a scanner unit disposed above a printing section which performs printing on a sheet; and is advantageous in that an image can be read by the scanner unit, and the thus-read image can be directly recorded by a printing section without by way of processing by an external personal computer, or the like.

However, in such an ink jet printer of a scanner-integrated type, the scanner unit is mounted above the printing section. Consequently, this type of ink jet printer has been disadvantageous in that the edge guide is hidden under the scanner unit mounted above, thereby degrading the edge guide in terms of ease of visual recognition. When the edge guide is degraded in ease of visual recognition, there may arise a problem such that a user, who has failed to recognize the presence of the edge guide, feeds a sheet without positioning the edge guide at an appropriate position, thereby causing a skew of the sheet, and eventually failure in obtainment of a favorable recording result In addition, when the edge guide is hidden under the scanner unit mounted above, operability of the edge guide is also degraded.

SUMMARY OF THE INVENTION

It is therefore an object of the invention to provide a medium feeder in which an ability required of an edge guide, that is, an ability of guiding a target medium is enhanced.

It is also an object of the invention to provide a user-friendly liquid ejecting apparatus or recording apparatus which does not degrade an edge guide in terms of ease of recognition nor operability even when a scanner unit is mounted above a printing section.

In order to achieve at least one of the above objects, according to the invention, there is provided a medium feeder, adapted to feed a target medium to a liquid ejecting section in which liquid is ejected toward the target medium, comprising:

a feeding roller, adapted to come in contact with the target medium, thereby feeding the target medium in a first direction;

a first supporter, opposing the feeding roller and having a first supporting face adapted to support the target medium;

a second supporter, disposed in an upper side of the first supporter and having a second supporting face adapted to support the target medium;

a first edge guide, provided on the first supporter so as to be movable in a second direction perpendicular to the first direction, and having a first guiding face adapted to come in contact with a first side edge of the target medium;

a second edge guide, provided on the second supporter so as to be movable in the second direction, and having a second guiding face adapted to come in contact with the first side edge of the target medium, the second edge guide being coupled with the first edge guide so that the first edge guide and the second edge guide move together; and a retainer, provided in the second edge guide and operable to retain the second edge guide at an arbitrary position within a movable range of the second edge guide.

With the above configuration, since the second edge guide is provided on the second supporter disposed above the first supporter opposing the feeding roller, ease of visual recognition of the edge guide can be ensured even when the scanner unit is mounted above the liquid ejecting section.

In addition, when the second edge guide located at a position which is favorable in terms of ease of visual recognition is operated, the first edge guide is simultaneously moved to displace. Thus, the necessity for independently displacing the two edge guides is obviated, thereby providing excellent operability.

Furthermore, since the retainer is disposed not on the side of the first edge guide but on the side of second edge guide, the first edge guide can be smoothly moved to displace when the second edge guide is operated.

In addition, by provision of the second edge guide, a side edge of the target medium is to be guided over a sufficient length along the first direction. Therefore, occurrence of a skew of target medium, which may otherwise occur during feeding, can be further reliably prevented.

The first edge guide and the second edge guide may be pivotable relative to each other.

With this configuration, since either the first supporter or the second supporter is allowed to pivot, the degree of flexibility in terms of design is enhanced.

Here, the first edge guide and the second edge guide may be coupled by way of a pivot shaft.

With this configuration, while being coupled reliably, the edge guides are allowed to pivot in relation to each other with the simple configuration. In addition, the first edge guide can be caused to displace pursuant to displacing action of the second movable edge guide.

Further, the first supporter may be pivotable between a first position at which the feeding roller comes in contact with the target medium and a second position at which the feeding roller separates from the target medium.

Further, the second supporter may be pivotable relative to the first supporter between a first position for opening the first supporting face and a second position for closing the first supporting face.

With this configuration, dusts are prevented from entering the first supporting face opposing the feeding roller when the medium feeder is not used.

The medium feeder may further comprise:

a third edge guide, provided on the first supporter so as to oppose the first edge guide, and having a third guiding face adapted to come in contact with a second side edge of the target medium which is opposite to the first side edge; and a fourth edge guide, provided on the second supporter so as to oppose the second edge guide, and having a fourth guiding face adapted to come in contact with the second side edge of the target medium.

With this configuration, since a position of the trailing end portion of the target medium is reliably regulated by the second edge guide and the fourth edge guide, occurrence of a skew can be further reliably prevented.

An angle formed by the first guiding face and the first supporting face may be no less than 90 degrees.

With this configuration, frictional resistance exerted on the edge of the target medium is decreased, thereby enabling smooth feeding of the target medium. In addition, the target medium lifted by the first supporter during feeding operation can return to its original position while being guided along the inclined guiding face. That is, the target medium can return to its original position without being caught by the edge guide. In addition, particularly when the inclined guiding face is formed at the downstream side in relation to the first direction, the recording medium, which is to be returned to the upstream side by a reversing lever, or the like, can return to its original position while being guided along the inclined guiding face. That is, the target medium can return to its original position without being caught by the edge guide.

Similarly, an angle formed by the second guiding face and the second supporting face may be no less than 90 degrees.

Similarly, an angle formed by the third guiding face and the first supporting face may be no less than 90 degrees.

Similarly, an angle formed by the fourth guiding face and the second supporting face may be no less than 90 degrees.

In order to achieve at least one of the above objects, according to the invention, there is provided a liquid ejecting apparatus, comprising:

a liquid ejecting section;

a liquid ejecting head, disposed in the liquid ejecting section and adapted to eject liquid toward a target medium;

a medium feeder, adapted to feed the target medium to the liquid ejecting section, the medium feeder comprising:

a feeding roller, adapted to come in contact with the target medium, thereby feeding the target medium in a first direction;

a first supporter, opposing the feeding roller and having a first supporting face adapted to support the target medium;

a second supporter, disposed in an upper side of the first supporter and having a second supporting face adapted to support the target medium;

a first edge guide, provided on the first supporter so as to be movable in a second direction perpendicular to the first direction, and having a first guiding face adapted to come in contact with a first side edge of the target medium;

a second edge guide, provided on the second supporter so as to be movable in the second direction, and having a second guiding face adapted to come in contact with the first side edge of the target medium, the second edge guide being coupled with the first edge guide so that the first edge guide and the second edge guide move together, and a retainer, provided in the second edge guide and operable to retain the second edge guide at an arbitrary position within a movable range of the second edge guide.

The liquid ejecting apparatus may further comprise a scanner unit disposed above the liquid ejecting section, wherein the second edge guide is arranged above the scanner unit.

With this configuration, the second edge guide is significantly favorable in terms of ease of visual recognition and operability.

In order to achieve at least one of the above objects, according to the invention, there is provided a recording apparatus, comprising:

a recording section;

a recording head, disposed in the recording section and adapted to perform recording on a target medium;

a medium feeder, adapted to feed the target medium to the recording section, the medium feeder comprising:

a feeding roller, adapted to come in contact with the target medium, thereby feeding the target medium in a first direction;

a first supporter, opposing the feeding roller and having a first supporting face adapted to support the target medium;

a second supporter, disposed in an upper side of the first supporter and having a second supporting face adapted to support the target medium;

a first edge guide, provided on the first supporter so as to be movable in a second direction perpendicular to the first direction, and having a first guiding face adapted to come in contact with a first side edge of the target medium;

a second edge guide, provided on the second supporter so as to be movable in the second direction, and having a second guiding face adapted to come in contact with the first side edge of the target medium, the second edge guide being coupled with the first edge guide so that the first edge guide and the second edge guide move together; and a retainer, provided in the second edge guide and operable to retain the second edge guide at an arbitrary position within a movable range of the second edge guide.

The recording apparatus may further comprise a scanner unit disposed above the recording section, wherein the second edge guide is arranged above the scanner unit.

With this configuration, the second edge guide is significantly favorable in terms of ease of visual recognition and operability.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the invention will be described below in detail with reference to the accompanying drawings.

Figure 3:
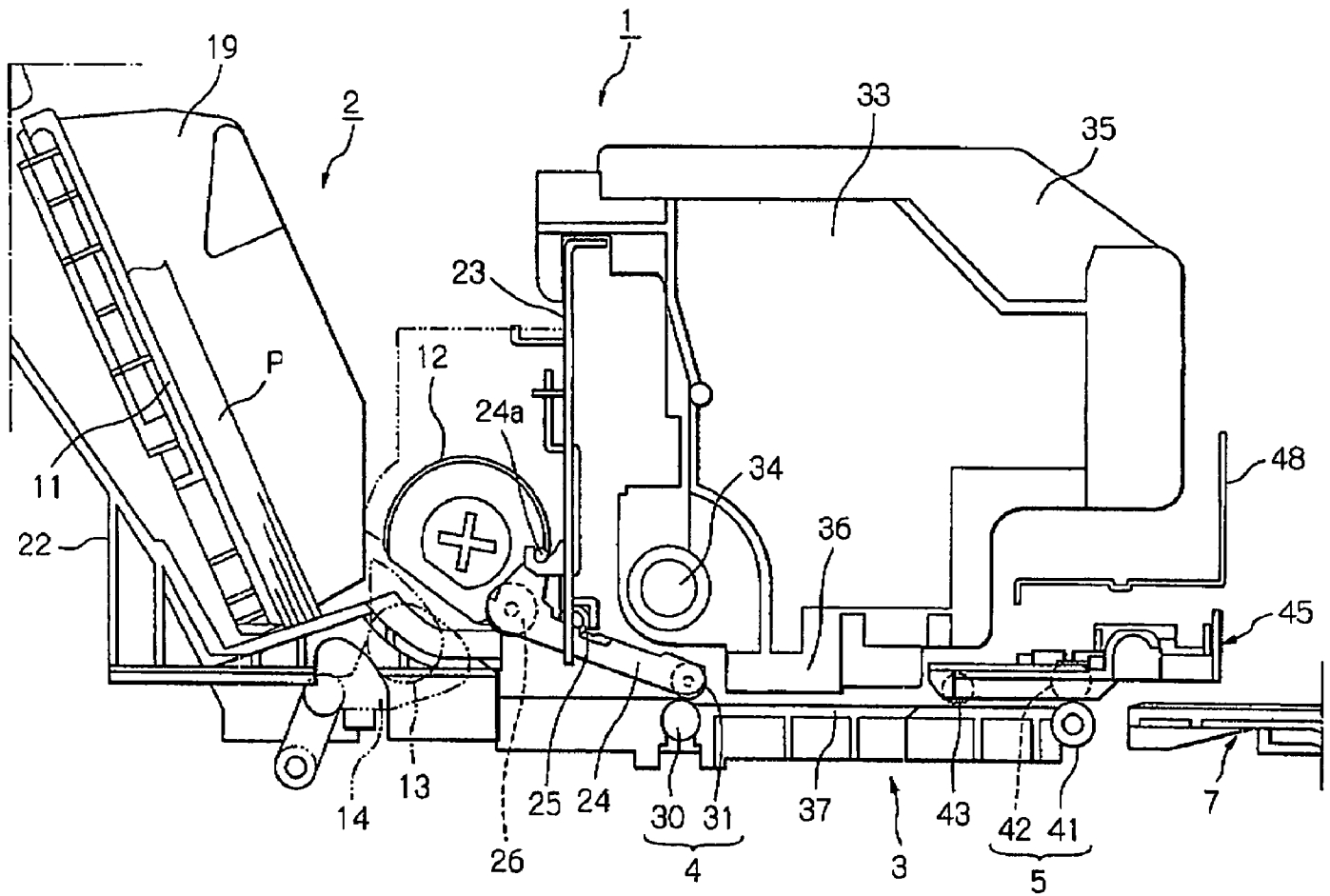
FIG. 3 is schematic section view of the printer.

An ink jet printer (hereinafter simply called a "printer") 1, which is employed as an example of a recording apparatus or a liquid ejecting apparatus, will be described as a first embodiment. In the following description, the right direction (the front side of the printer) in FIG. 3 will be referred to as "downstream" relative to a transporting direction of a recording medium (target medium). The left direction (the rear side of the printer) will be referred to as "upstream" relative to the transporting direction.

Figure 1:
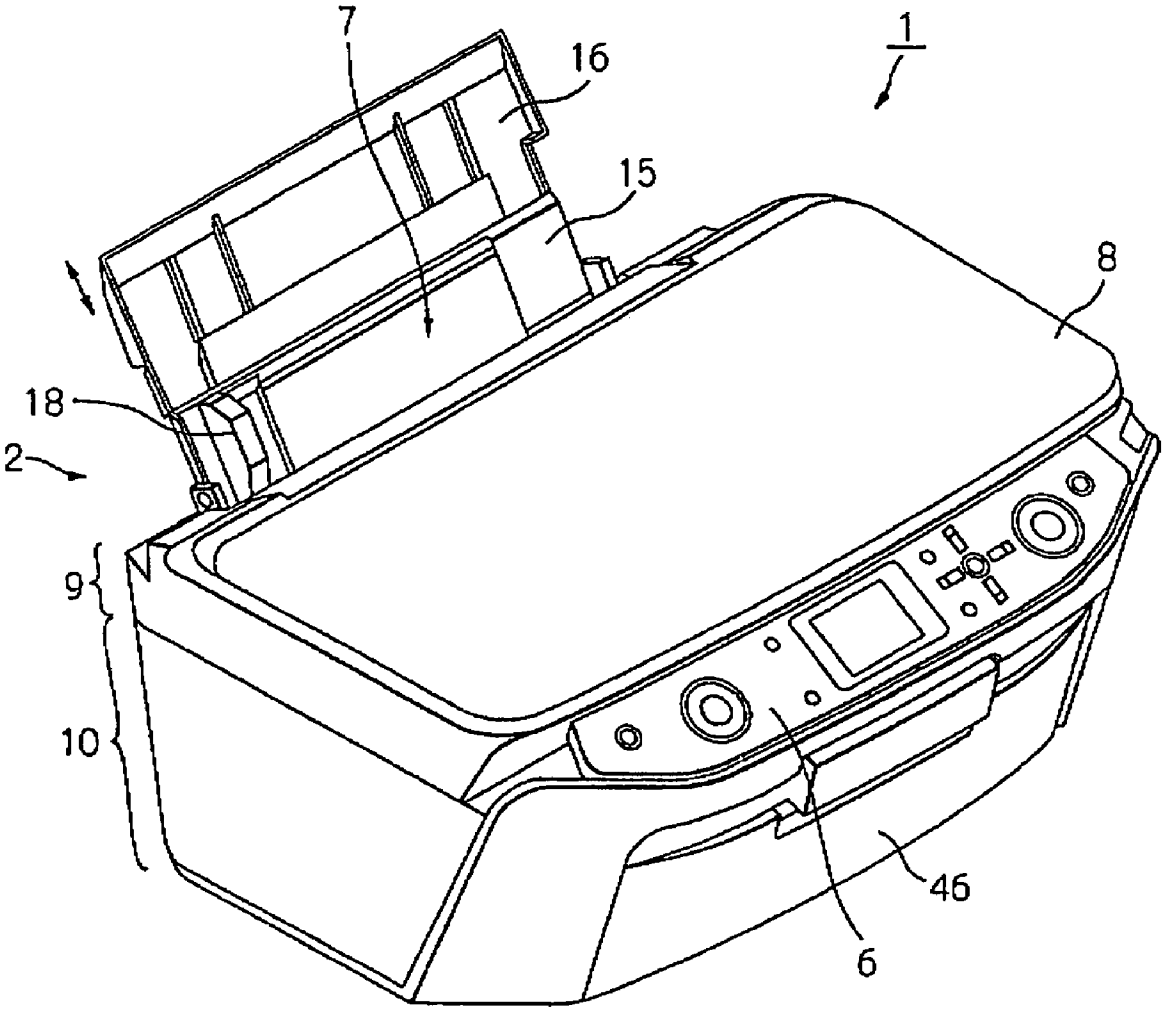
FIG. 1 is a perspective view of a printer according to a first embodiment of the invention, showing a state that a feeder is used.
Figure 2:
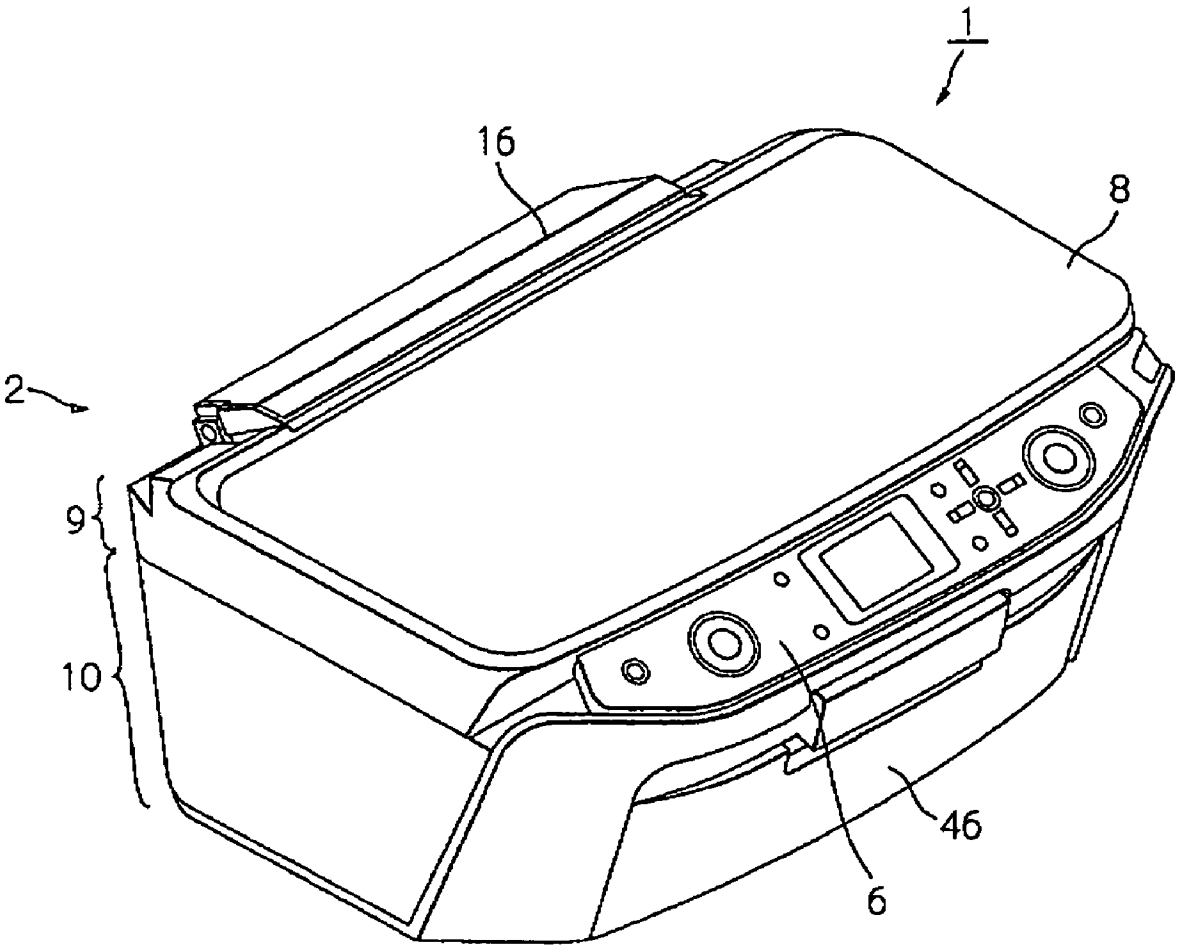
FIG. 2 is a perspective view of the printer, showing a state that the feeder is not used.

As illustrated in FIGS. 1 and 2, the printer 1 is a printer of a type provided with a scanner function in addition to a printer function. The printer 1 comprises a printer section 10, a scanner unit 9 located above the printer section 10, and a medium feeder (hereinafter called a "feeder") 2 provided in the rear part of the printer section 10. The printer section 10 has a function of an ink jet printer for performing ink jet recording primarily on a recording sheet (primarily a cut sheet; hereinafter called a "sheet P") serving as a target medium.

In FIGS. 1 and 2, each of the members denoted by reference numeral 46 is a front cover for blocking an ejection port through which the sheet P having been undergone recording is ejected. The front cover 46 opens the ejection port in a state of being pivoted toward the front by approximately 90° when the printer function is used. A control panel 6 is provided on the upper front side of the printer section 10. The operation panel 6 enables operations pertaining to the scanning function with use of the scanner unit 9, a recording function in the printer section 10, a function of recording an image having been scanned; and the like.

The scanner unit 9 has a top cover 8 which is pivotable about an unillustrated pivot shaft (provided on the rear side). A glass table (not shown) on which an original to be scanned is placed is provided under the top cover 8. A scanning device (not shown) is provided further below the glass table. The scanner unit 9 per se pivots upward about an unillustrated pivot shaft (provided on the rear side), thereby opening an upper portion of the printer section 10, to thus enable maintenance of members in the recording section, such as a carriage.

An inlet 7 (see FIG. 1) through which the sheet P is to be set is provided in the feeder 2. The inlet 7 is blocked by an auxiliary supporter 16 (and a supporter 15) when the feeder 2 is not being used. There is adopted such a configuration that the auxiliary supporter 16 and the supporter 15 are pivoted rearward as illustrated in FIG. 1 when the feeder 2 is not being used, thereby bringing the inlet 7 into an open state. Accordingly, entry of dust through the inlet 7 can be prevented when the feeder 2 is not being used, and the external appearance of the apparatus can be ensured to be good. Meanwhile, the auxiliary supporter 16 is attached so as to be slidable along the lengthwise direction (the direction indicated by an arrow in FIG. 1) of the sheet P in relation to the supporter 15. When being used, a face for supporting the sheet P is extended by being pulled forward as illustrated in FIG. 1, thereby supporting a rear end of the sheet P more reliably.

In the feeder 2, the sheets P can be set in an inclined posture. A sheet P is fed from the feeder 2 to a transporter 4 located downstream. The thus-fed sheet P is transported downstream to a recording section 3 by the transporter 4, whereby recording is effected. The sheet P recorded by the recording section 3 or an optical disk mounted on a tray (not shown) is ejected forward of the recording apparatus by an ejector 5 located downstream.

Constituent elements disposed in the medium transporting path of the printer 1 will be described in more detail. The feeder 2 is constructed of a hopper 11, a feeding roller 12, a retard roller 13, and a returning lever 14.

The hopper 11 is formed from a plate-shaped element and constructed to be able to pivot about a pivot center (not shown) provided in an upper part of the hopper 11. As a result of the hopper 11 pivoting, the inclined sheet P supported on the hopper 11 is brought into press contact with the feeding roller 12 or caused to retract from the feeding roller 12. The feeding roller 12 essentially assumes the shape of the letter D when viewed from the side. The feeding roller 12 feeds downstream the top sheet P, which remains in press contact with an arcuate portion of the D-shaped cross section of the feeding roller 12. During the course of the sheet P being transported by the transporter 4 after feeding of the sheet P, the transporter 4 is controlled such that a flat portion of the D-shaped cross section of the feeding roller 12 opposes the sheet P as illustrated, so as to prevent occurrence of transport load.

The retard roller 13 is provided so as to be able to come into press contact with the arcuate portion of the feeding roller 12. When overlapping transfer of the sheets P does not arise and only one sheet P is being fed, the retard roller 13 comes into contact with the sheet P to be thus rotated (clockwise in FIG. 2). When a plurality of the sheets P are present between the feeding roller 12 and the retard roller 13, the retard roller 13 does not rotate and remains stationary, because the frictional coefficient between the sheets P is lower than the frictional coefficient between the sheet P and the retard roller 13. Consequently, sheets P, which are subsequent to the top sheet P and are about to be delivered in an overlapping manner along with the top sheet P to be fed, do not proceed downstream from the retard roller 13, thereby preventing overlapped delivery of the sheets P. The returning lever 14 is pivotably provided and performs operation for returning to the hopper 11 sheets P, which are subsequent to the top sheet and have been prevented from being delivered in an overlapping manner.

A sensor (not shown) for detecting passage of the sheet P and a guide roller 26, which sets an attitude for feeding the sheet P and prevents the sheet P from contacting the feeding roller 12 to thus lessen transport load, are interposed between the feeding device 2 and the transporter 4. In the present embodiment, the guide roller 26 is rotatably supported by an upstream end of an upper guide 24.

The transporter 4 provided downstream of the feeder 2 comprises a transporting roller 30 rotationally driven by a motor and a transporting follower roller 31 which comes into press contact with the transporting roller 30 and rotates in a following manner. The transporting roller 30 is formed from an adhesion layer which is formed by dispersing, in an essentially uniform manner, wear-and-abrasion resistant particles over an outer peripheral surface of a metal shaft extending in the widthwise direction of the sheet. An outer peripheral surface of the transporting follower roller 31 is formed from low frictional material, such as an elastomer or the like. A plurality of the transporting follower rollers 31 are provided around the transporting roller 30 in the axial direction thereof.

In the present embodiment, two transporting follower rollers 31 are axially supported by a downstream end portion of one upper paper guide 24 so as to be able to freely rotate. As shown in FIG. 1, three transporting follower rollers 31 are arranged side by side on the paper guide 24 in the widthwise direction of the sheet. A shaft 24*a* is axially supported by a main frame 23, and hence the sheet guide 24 is pivotable about the shaft 24*a* when the medium transporting path is viewed from the side. The transporting follower rollers 31 are urged by a coil spring 25 in a direction to come into press contact with the transporting roller 30.

The sheet P having reached the transporter 4 is transported to the recording section 3 located downstream, by rotation of the transporting roller 30, while being nipped between the transporting roller 30 and the transporting follower rollers 31.

The recording section 3 comprises an ink jet recording head (hereinafter referred to as a "recording head") 36 and a lower guide 37 provided so as to oppose the recording head 36. The recording head 36 is provided at the bottom of a carriage 33, and the carriage 33 is driven so as to move back and forth in the primary scanning direction by an unillustrated motor while being guided by a carriage guide shaft 34 extending in the primary scanning direction. The carriage 33 carries ink cartridges 35 of a plurality of colors which are independent of each other, and supplies ink to the recording head 36.

Ribs (not shown) and a recess (not shown), where ink is discarded, are formed on a surface of the lower guide 37 opposing the recording head 36, which defines a distance between the sheet P and the recording head 36. Ink ejected to an area outside the edges of the sheet P is discarded to the recess, thereby effecting so-called marginless printing where printing is carried out so as not to leave margins on the sheet P.

Subsequently, a guide roller 43 and the ejector 5 are provided downstream of the recording head 36. The guide roller 43 exhibits the function of preventing lift of the sheet P from the lower guide 37, to thus maintain the distance between the sheet P and the recording head 36 constant. The ejector 5 comprises an ejecting roller 41 to be rotationally driven by the unillustrated motor; and an ejecting follower roller 42 which comes into contact with the ejecting roller 41 and is rotated in a driven manner. In the present embodiment, the ejecting roller 41 is formed from a rubber roller, and a plurality of the ejecting rollers 41 are provided around a shaft element, which is rotationally driven, in an axial direction thereof.

The ejecting follower roller 42 is formed from a toothed roller having a plurality of teeth provided along an outer periphery thereof. A plurality of the ejecting follower rollers 42 are provided in a frame assembly 45, which is elongated in the primary scanning direction, so as to correspond to the plurality of ejecting rollers 41. The sheet P, on which information is recorded by the recording section 3, is rotationally driven by the ejecting rollers 41 while being nipped between the ejecting rollers 41 and the ejecting follower rollers 42, and is ejected forward of the recording apparatus to an ejected sheet stacker (not shown).

The frame assembly 45 is provided in such a way that the assembly can be displaced by a releaser 6 (described later) so as to be able to assume a contact position where the ejecting follower rollers 42 come into contact with the ejecting rollers 41, and a retracted position where the ejecting follower rollers 42 are retracted from the ejecting rollers 41.

Figure 4:
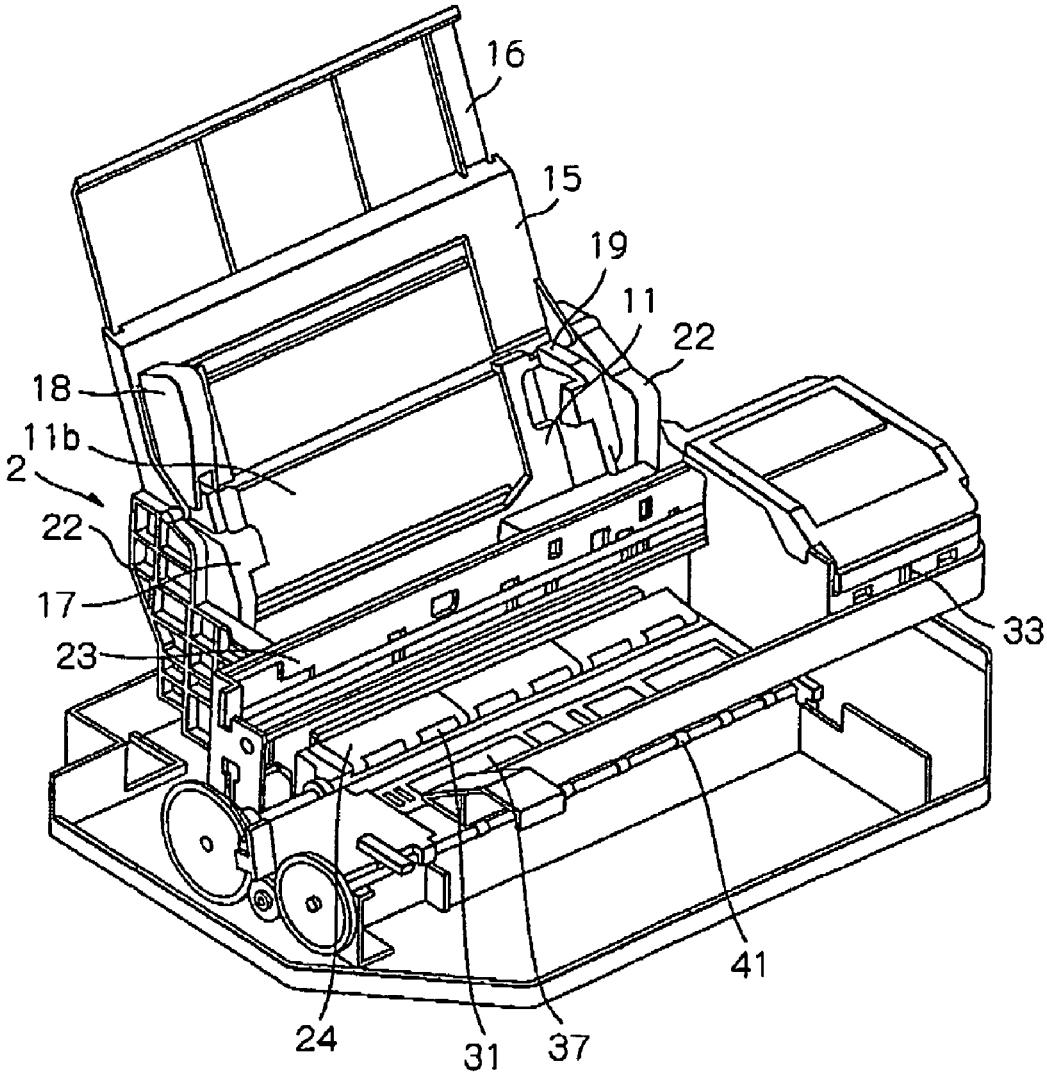
FIG. 4 is a perspective view of a printing section in the printer.

As illustrated in FIG. 4, the feeder 2 comprises the hopper 11 for supporting the sheet P; and the supporter 15 for supporting the trailing end side of the sheet P. The hopper 11 is formed by extending a sheet supporting face 11*b* of the hopper 11 in the direction of the rear end of the sheet P. The first movable edge guide 17 and a fixed edge guide 19 are disposed on the hopper 11 so as to oppose each other. The second movable edge guide 18 is disposed on the supporter 15. The first movable edge guide 17 and the second movable edge guide 18 are positioned so as to oppose the edge on one side of the sheet P; and the fixed edge guide 19 is positioned so as to oppose the edge on the other side of the sheet P. Hence, the respective edge guides are brought into contact with the corresponding edges of the sheet P, thereby guiding the positions of the edges.

The first movable edge guide 17 is disposed on the hopper 11 so as to be slidable in the widthwise direction of the sheet P. Similarly, the second movable edge guide 18 is disposed on the supporter 15 so as to be slidable in the widthwise direction of the sheet P. With this configuration, the first movable edge guide 17 and the second movable edge guide 18 can displace to an appropriate position adapted to the width of the sheet P. In addition, the first movable edge guide 17 and the second movable edge guide 18 are engaged together in such a manner that, when the second movable edge guide 18 is operated (subjected to displacing action), the first movable edge guide 17 is moved to displace pursuant to the displacing action of the second movable edge guide 18 (described later in detail).

Figure 5B:
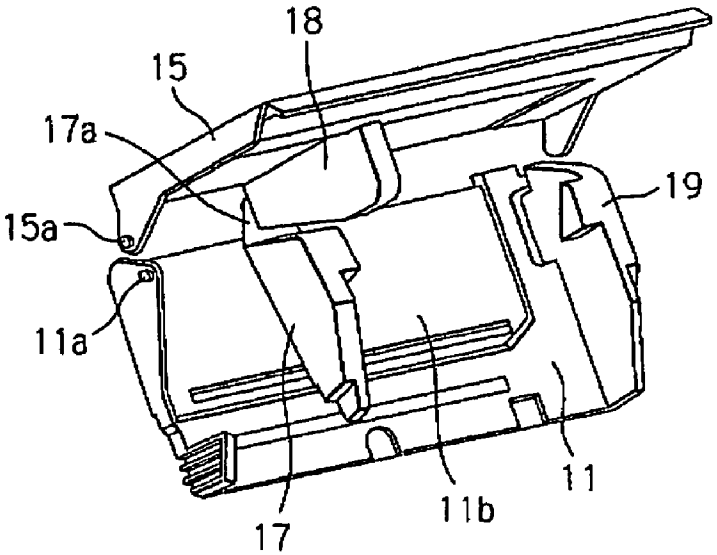
FIG. 5B is a perspective view of the hopper, the medium supporter and the movable edge guides placed in different positions from FIG. 5A.
Figure 5A:
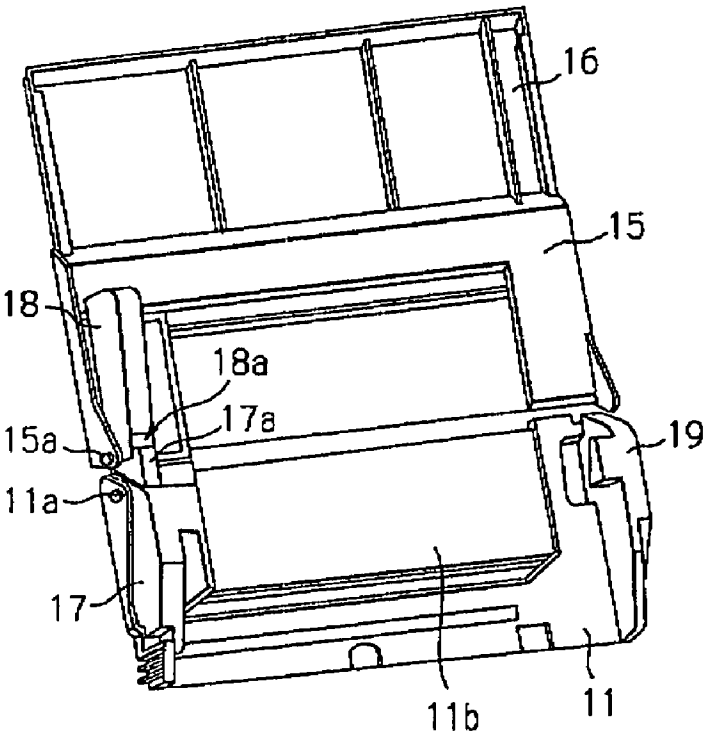
FIG. 5A is a perspective view of a hopper, a medium supporter and movable edge guides in the feeder.

As shown in FIGS. 5A and 5B, a pivot shaft 11 a of the hopper 11 is supported on a frame 22, which forms a base body of the feeder 2. Similarly, a pivot shaft 15*a* of the supporter 15 is also supported on the frame 22. With this configuration, the hopper 11 and the supporter 15 are pivotable together relative to the frame 22.

In addition, the first movable edge guide 17 disposed on the hopper 11 and the second movable edge guide 18 disposed on the supporter 15 are coupled (engaged) together by way of a coupling shaft (not shown), and are configured to be pivotable in relation to each other while taking the coupling shaft as a pivot shaft, so as to allow the hopper 11 and the supporter 15 to pivot. More specifically, as illustrated in FIG. 5A, a projection 17*a*, which projects toward the second movable edge guide 18, on the first movable edge guide 17 is inserted into a receiving section 18*a* formed in the second movable edge guide 18, and coupled therewith by a coupling shaft (not shown) inside the receiving section 18*a*. With this configuration, the first movable edge guide 17 is moved to displace in the sheet widthwise direction pursuant to the displacing action of the second movable edge guide 18; and the two edge guides can pivot in relation to each other as illustrated in FIGS. 5A and 5B.

The first movable edge guide 17 and the second movable edge guide 18 are not necessarily coupled by the coupling shaft. An essential requirement is that the two edge guides be configured to be pivotable in relation to each other, so as to allow the hopper 11 or the supporter 15 to pivot For instance, the first movable edge guide 17 is moved to displace in the widthwise direction pursuant to displacing action of the second movable edge guide 18 even when the projection 17*a* is only inserted into the receiving section 18*a* in a non-coupling manner. Alternatively, when the hopper 11 or the supporter 15 pivots, the first movable edge guide 17 and the second movable edge guide 18 are to be relatively pivoted in accordance therewith.

Figure 6:
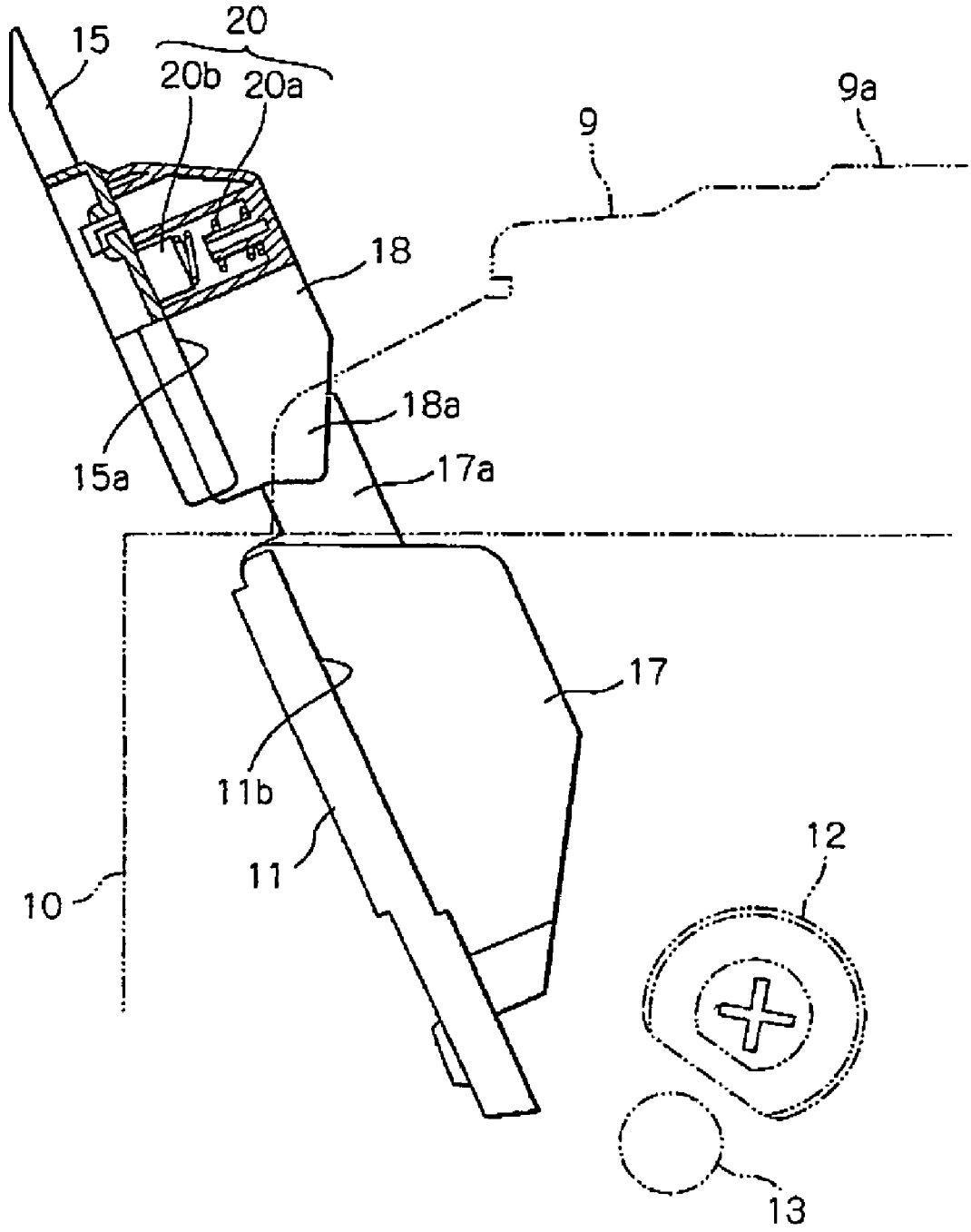
FIG. 6 is a partial section view of the hopper, the medium supporter and the movable edge guides.

The first movable edge guide 17 and the second movable edge guide 18 configured as above are retained at an appropriate position for guiding the side end of the sheet P by a retainer 20 disposed on the second movable edge guide 18. The retainer 20 includes a tension spring 20*a* and a high-friction member (e.g., a rubber pad) 20*b* as illustrated in FIG. 6. The tension spring 20*a* urges the high-friction member 20*b* toward a sheet supporting face 15*a* on the supporter 15. That is, the second movable edge guide 18 (along with the first movable edge guide 17) is retained by friction between the high-friction member 20*b* and the sheet supporting face 15*a*.

As described the above, the feeder 2 according to the present invention comprises not only the first movable edge guide 17 disposed on the hopper 11 but also the second movable edge guide 18 disposed on the supporter 15 for supporting the rear end of the sheet. With this configuration, the edge guide can be readily visually recognized from the outside of the feeder even when the scanner unit is mounted above the printer section. Hence, there can be prevented problems such that a user, who has failed to recognize the presence of the edge guide, feeds a sheet without positioning the edge guide at an appropriate position, thereby causing a skew of the sheet and failing in obtainment of a favorable recording result; and that operability pertaining to operations of the edge guide is degraded.

In particular, in the present embodiment, the first movable edge guide 17 is located below the scanner unit 9 as illustrated in FIG. 6; and the second movable edge guide 18 is disposed so as to be exposed above the printer section 10 in the region to the rear of the scanner unit 9 as illustrated in FIGS. 1 and 6. With this configuration, the second movable edge guide 18 is significantly favorable in terms of ease of visual recognition and operability.

In addition, by provision of the second movable edge guide 18, the side end of the sheet P is to be guided over a sufficient length in the lengthwise direction (the feeding direction) thereof. Therefore, the sheet P can be reliably prevented from being skewed during feeding.

Furthermore, since the first movable edge guide 17 and the second movable edge guide 18 are engaged together, when the second movable edge guide 18 located at a position which is favorable in terms of ease of visual recognition is operated, the first movable edge guide 17 is simultaneously moved to displace. Hence, excellent operability is attained.

In addition, since the retainer 20 for retaining the first movable edge guide 17 and the second movable edge guide 18 at a given position is disposed on the second movable edge guide 18, the first movable edge guide 17 can be moved to displace smoothly when the second movable edge guide 18 is operated. Put another way, if the retainer 20 is disposed on the first movable edge guide 17, when the second movable edge guide 18 located at a position of good accessibility is operated, since the operation portion (where a force is to be applied) and the retainer 20 are apart, a turning moment whose center is at the retainer 20 is produced. Accordingly, the first movable edge guide 17 may fail to be moved to displace smoothly even when the second edge 18 is operated. However, since the retainer 20 is disposed on the second movable edge guide 18, when the second edge 18 is operated, the first movable edge guide 17 can be moved to displace smoothly.

Next, a second embodiment of the invention will be described. Components similar to those in the first embodiment will be designated by the same reference numerals and repetitive explanations for those will be omitted.

Figure 7:
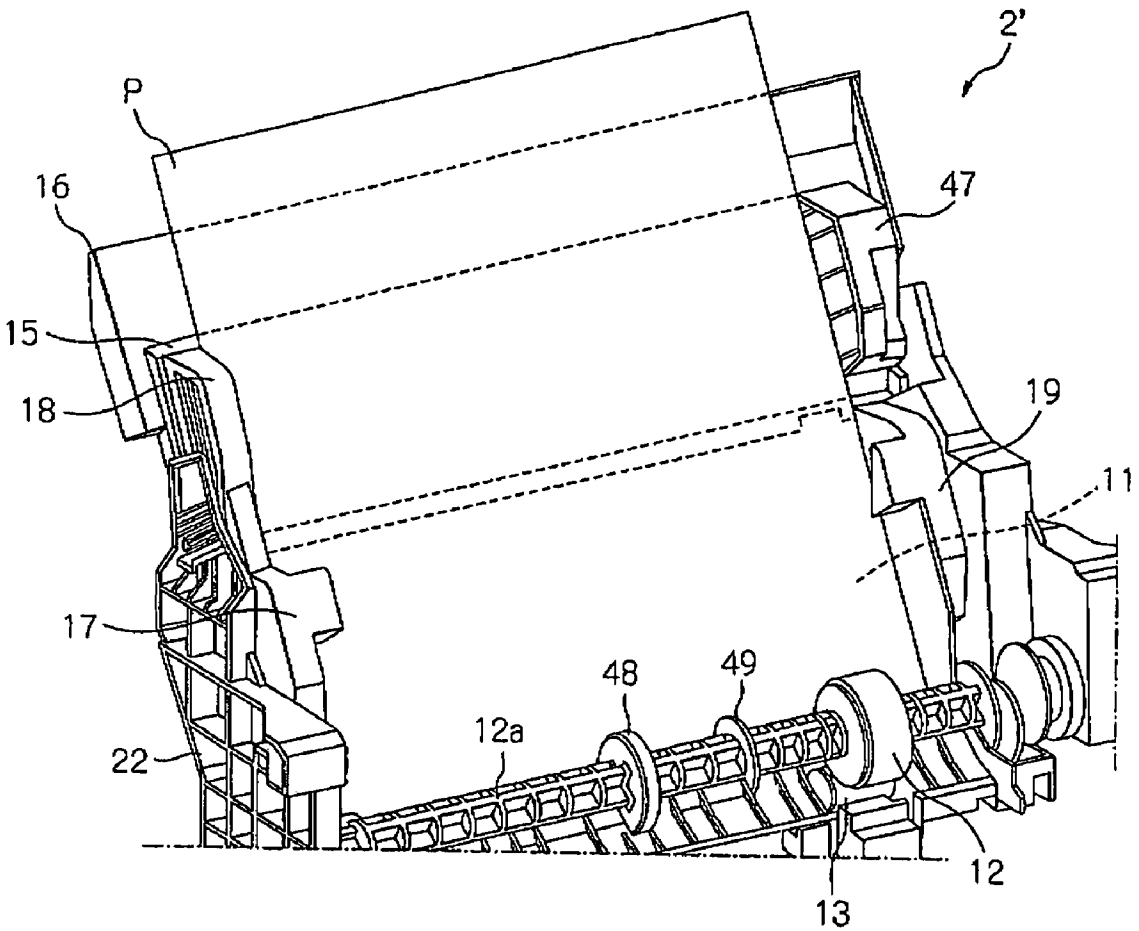
FIG. 7 is a perspective view of a feeder in a printer according to a second embodiment of the invention.

As shown in FIG. 7, in this embodiment, a second fixed edge guide 47 is disposed on the supporter 15. Here, the fixed edge guide 19 is referred as a first fixed edge guide.

The second fixed edge guide 47 is disposed at a position opposing the second movable edge guide 18. The second fixed edge guide 47, together with the second movable edge guide 18, regulates a position of an edge of the recording sheet P at the trailing end side of the recording sheet P. Meanwhile, the second fixed edge guide 47 is formed into a shape which does not interfere with the first fixed edge guide 19 when the supporter 15 pivots as if the supporter 15 tilts frontward of the feeder as illustrated in FIG. 2 or 5B; that is, into a shape which does not inhibit the pivot motion of the supporter 15.

By provision of the second fixed edge guide 47 as described above, the edge-guiding ability provided by the first fixed edge guide 19 extends to the trailing end side of the recording sheet P. Therefore, edge positions of the recording sheet P are regulated at opposite sides without fail by the second movable edge guide 18 and the second fixed edge guide 47, thereby preventing occurrence of a skew more reliably. Meanwhile, in the present embodiment, the first fixed edge guide 19 and the second fixed edge guide 47 are respectively fixed on the hopper 11 and the supporter 15. However, as in the case of the first movable edge guide 17 and the second movable edge guide 18; they may be disposed slidably in the sheet widthwise direction.

In this embodiment, an auxiliary roller 48 which rotates together with the feeding roller 12 is disposed on the rotary shaft 12*a* of the feeding roller 12 at a position separated from the feeding roller 12 along the axial direction of the rotary shaft 12*a*. The auxiliary roller 48 is substantially D-shaped in side view as in the feeding roller 12, and formed into substantially the same size (in outer diameter) as the feeding roller 12. The shape (curved state) during feeding of the recording sheet P is formed by at least two rollers constituted of the feeding roller 12 and the auxiliary roller 48. With this configuration, the shape (the curved state) of the sheet P in the widthwise direction thereof during feeding exhibits no variation, thereby preventing occurrence of a skew. Another auxiliary roller 49 is additionally provided between the feeding roller 12 and the auxiliary roller 48, thereby adapting to feed a recording sheet which is small in width.

The sheet P under feeding receives a force (a feeding force) which urges to dispense the sheet P in the feeding direction at a position of the feeding roller 12 in the sheet widthwise direction. However, since no retard roller 13 is provided on the side of the auxiliary roller 48, the sheet P does not receive such a force at a position of the auxiliary roller 48.

Therefore, the feeding force is offset in the sheet widthwise direction to the side of the feeding roller 12. However, with respect to a recording sheet P of a specific size (FIG. 7 shows a state in which a sheet of A4 size is set in the portrait orientation), the feeding roller 12 is to be positioned at a position shifted from the center position in the widthwise direction (rightward in FIG. 7). Therefore, when the recording sheet P of such a size is fed, the recording sheet P is likely to be inclined clockwise in FIG. 7; that is, a skew is likely to occur.

In addition, since no retard roller 13 is provided at a portion of the auxiliary roller 48, in conjunction with the uppermost recording sheet P to be fed, recording sheets P subsequent thereto readily enter into the portion of the auxiliary roller 48. When a number of recording sheets P enter into the portion of the auxiliary roller 48, advancement of the uppermost recording sheet P is inhibited at the portion of the auxiliary roller 48. Accordingly, the uppermost recording sheet P is also likely to undergo such a skew as to be inclined clockwise while taking the portion of the auxiliary roller 48 as a fulcrum.

However, as described above, the trailing end side of the sheet P is regulated by the second fixed edge guide 47 and the second movable edge guide 18 at opposite sides without fail; and, in particular, the second fixed edge guide 47 is disposed on the feeding roller 12. Accordingly, even when the auxiliary roller 48 is included, occurrence of a skew can be prevented without fail. Put another way, occurrence of a skew can be prevented while the shapes of the recording sheets P under feeding are aligned in the transverse direction.

Figure 8:
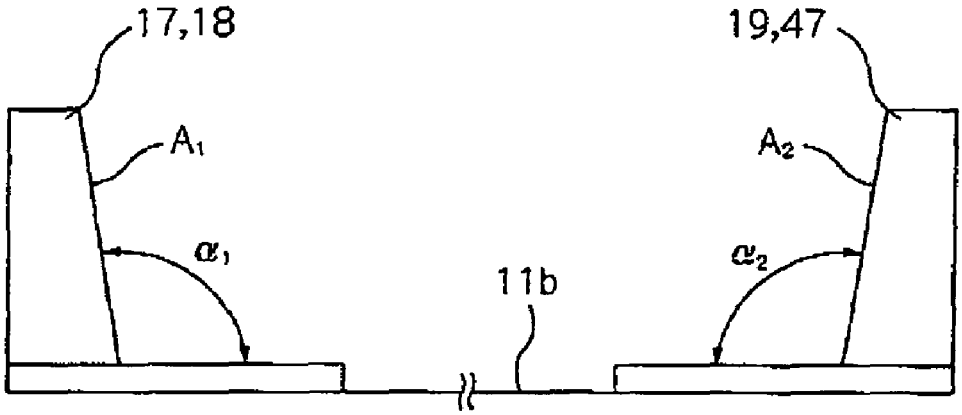
FIG. 8 is a schematic view showing angles of guide faces of edge guides in the feeder of FIG. 7.

In the present embodiment, as illustrated in FIG. 8, an inclined face whose angle (denoted by $\alpha 1$, $\alpha 2$) in relation to the sheet supporting face 11*b* is larger than 90° is formed on at least a portion of either one or each of a first guiding face A1 for guiding the edge on one side of the sheet P, and a second guiding face A2 for guiding the edge on the other side of the sheet P. The first guiding face A1 is formed from the first movable edge guide 17 and the second movable edge guide 18; and the second guiding face A2 is formed from the first fixed edge guide 19 and the second fixed edge guide 47.

As shown in FIG. 8, the following setting is adopted for the angles: $\alpha 1$ =92°, and $\alpha 2$=90°, Put another way, the guiding face A1, which is formed from the first movable edge guide 17 and the second movable edge guide 18 and which regulates the edge of the sheet P, is formed from the inclined face having such a shape as to be gradually expanded upward. With this configuration, frictional resistance exerted on the edge of the sheet P by the first movable edge guide 17 and the second movable edge guide 18 is decreased, thereby enabling smooth feeding of the sheet P. In addition, the sheet P to be returned onto the hopper 11 by the reversing lever 14 can return to its original position while being guided along the guiding face A1 formed by the inclined face. That is, the sheet P can return to its original position without being caught by the first and the second fixed edge guides.

Meanwhile, in the present embodiment, the inclined face is formed on each of the first movable edge guide 17 and the second movable edge guide 18. Alternatively, there may be adopted such a configuration that the inclined face is formed on only the first movable edge guide 17, and the second movable edge guide 18 is formed into a vertical face.

In addition to the above, the inclined face may be formed on the side of the first fixed edge guide 19 and the second fixed edge guide 47. Alternatively, the inclined face may be formed only on the side of the first fixed edge guide 19 and the second fixed edge guide 47. In this case, the inclined face maybe formed on each of the first fixed edge guide 19 and the second fixed edge guide 47. Alternatively, there may be adopted such a configuration that the inclined face is formed on only the first fixed edge guide 19, and the second fixed edge guide 47 is formed into a vertical face.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A medium feeder, adapted to feed a target medium to a liquid ejecting section in which liquid is ejected toward the target medium, comprising:

a feeding roller, adapted to come in contact with the target medium, thereby feeding the target medium in a first direction;

a first supporter, opposing the feeding roller and having a first supporting face adapted to support the target medium;

a second supporter, disposed in an upper side of the first supporter and having a second supporting face adapted to support the target medium;

a first edge guide, provided on the first supporter so as to be movable in a second direction perpendicular to the first direction, and having a first guiding face adapted to come in contact with a first side edge of the target medium;

a second edge guide, provided on the second supporter so as to be movable in the second direction relative to the second supporting face, and having a second guiding face adapted to come in contact with the first side edge of the target medium, the second edge guide being coupled with the first edge guide so that the first edge guide and the second edge guide move together; and a retainer, provided in the second edge guide and operable to retain the second edge guide at an arbitrary position within a movable range of the second edge guide by not engaging the first edge guide with the first supporter but engaging the second edge guide with the second supporting face.

2. The medium feeder as set forth in claim 1, wherein the first edge guide and the second edge guide are pivotable relative to each other.

3. The medium feeder as set forth in claim 2, wherein the first edge guide and the second edge guide are coupled by way of a pivot shaft.

4. The medium feeder as set forth in claim 2, wherein the first supporter is pivotable between a first position at which the feeding roller comes in contact with the target medium and a second position at which the feeding roller separates from the target medium.

5. The medium feeder as set forth in claim 2, wherein the second supporter is pivotable relative to the first supporter between a first position for opening the first supporting face and a second position for dosing the first supporting face.

6. The medium feeder as set forth in claim 1, further comprising:

a third edge guide, provided on the first supporter so as to oppose the first edge guide, and having a third guiding face adapted to come in contact with a second side edge of the target medium which is opposite to the first side edge; and a fourth edge guide, provided on the second supporter so as to oppose the second edge guide, and having a fourth guiding face adapted to come in contact with the second side edge of the target medium.

7. The medium feeder as set forth in claim 1, wherein an angle formed by the first guiding face and the first supporting face is no less than approximately 90 degrees.

8. The medium feeder as set forth in claim 1, wherein an angle formed by the second guiding face and the second supporting face is no less than approximately 90 degrees.

9. The medium feeder as set forth in claim 6, wherein an angle formed by the third guiding face and the first supporting face is no less than approximately 90 degrees.

10. The medium feeder as set forth in claim 6, wherein an angle formed by the fourth guiding face and the second supporting face is no less than approximately 90 degrees.

11. A liquid ejecting apparatus, comprising:

a liquid ejecting section;

a liquid ejecting head, disposed in the liquid ejecting section and adapted to eject liquid toward a target medium;

a medium feeder, adapted to feed the target medium to the liquid ejecting section, the medium feeder comprising:

a feeding roller, adapted to come in contact with the target medium, thereby feeding the target medium in a first direction;

a first supporter, opposing the feeding roller and having a first supporting face adapted to support the target medium;

a second supporter, disposed in an upper side of the first supporter and having a second supporting face adapted to support the target medium;

a first edge guide, provided on the first supporter so as to be movable in a second direction perpendicular to the first direction, and having a first guiding face adapted to come in contact with a first side edge of the target medium;

a second edge guide, provided on the second supporter so as to be movable in the second direction relative to the second supporting face, and having a second guiding face adapted to come in contact with the first side edge of the target medium, the second edge guide being coupled with the first edge guide so that the first edge guide and the second edge guide move together; and a retainer, provided in the second edge guide and operable to retain the second edge guide at an arbitrary position within a movable range of the second edge guide by not engaging the first edge guide with the first supporter but engaging the second edge guide with the second supporting face.

12. The liquid ejecting apparatus as set forth in claim 11, further comprising a scanner unit disposed above the liquid ejecting section, wherein the second edge guide is arranged above the scanner unit.

13. A recording apparatus, comprising:

a recording section;

a recording head, disposed in the recording section and adapted to perform recording on a target medium;

a medium feeder, adapted to feed the target medium to the recording section, the medium feeder comprising:

a feeding roller, adapted to come in contact with the target medium, thereby feeding the target medium in a first direction;

a first supporter, opposing the feeding roller and having a first supporting face adapted to support the target medium;

a second supporter, disposed in an upper side of the first supporter and having a second supporting face adapted to support the target medium;

a first edge guide, provided on the first supporter so as to be movable in a second direction perpendicular to the first direction, and having a first guiding face adapted to come in contact with a first side edge of the target medium;

a second edge guide, provided on the second supporter so as to be movable in the second direction relative to the second supporting face, and having a second guiding face adapted to come in contact with the first side edge of the target medium, the second edge guide being coupled with the first edge guide so that the first edge guide and the second edge guide move together; and a retainer, provided in the second edge guide and operable to retain the second edge guide at an arbitrary position within a movable range of the second edge guide by not engaging the first edge guide with the first supporter but engaging the second edge guide with the second supporting face.

14. The recording apparatus as set forth in claim 13, further comprising a scanner unit disposed above the recording section, wherein the second edge guide is arranged above the scanner unit.

15. The medium feeder as set forth in claim 1, wherein the retainer includes:

a high-friction member disposed on the second supporting surface and having a friction coefficient which is higher than a friction coefficient of the second supporting surface; and an urging member urging the high-friction member toward the second supporting surface.

* * * * *